US009122220B2

(12) United States Patent
Numazu

(10) Patent No.: US 9,122,220 B2
(45) Date of Patent: Sep. 1, 2015

(54) PRINTING APPARATUS, PRINTING METHOD, AND STORAGE MEDIUM WHICH CONTROL PRINTING BASED ON DETECTION OF A MARK BY A SENSOR

(71) Applicants: CASIO ELECTRONICS MANUFACTURING CO., LTD., Iruma-shi, Saitama (JP); CASIO COMPUTER CO., LTD., Shibuya-ku, Tokyo (JP)

(72) Inventor: Toshihiko Numazu, Sayama (JP)

(73) Assignees: CASIO ELECTRONICS MANUFACTURING CO., LTD., Iruma-shi, Saitama (JP); CASIO COMPUTER CO., LTD., Tokyo (JP)

( * ) Notice: Subject to any disclaimer, the term of this patent is extended or adjusted under 35 U.S.C. 154(b) by 124 days.

(21) Appl. No.: 13/959,355

(22) Filed: Aug. 5, 2013

(65) Prior Publication Data

US 2014/0064747 A1 Mar. 6, 2014

(30) Foreign Application Priority Data

Sep. 5, 2012 (JP) ..... 2012-195385

(51) Int. Cl.
*G03G 15/00* (2006.01)

(52) U.S. Cl.
CPC ..... *G03G 15/65* (2013.01); *G03G 15/5062* (2013.01); *G03G 15/652* (2013.01)

(58) Field of Classification Search
CPC . G03G 15/65; G03G 15/5062; G03G 15/652; G03G 15/6523; G03G 15/6517; G03G 2215/00455
See application file for complete search history.

(56) References Cited

U.S. PATENT DOCUMENTS 4,890,140 A * 12/1989 Negoro et al. ..... 399/322
5,008,710 A * 4/1991 Kobayashi et al. ..... 399/317
5,063,416 A * 11/1991 Honda et al. ..... 399/384
5,532,811 A * 7/1996 Nishikawa et al. ..... 399/384

(Continued)

FOREIGN PATENT DOCUMENTS

EP 2223808 A1 9/2010
JP 02057371 A 2/1990

(Continued)

OTHER PUBLICATIONS

A machine translation of JP 2010-097132.*

(Continued)

*Primary Examiner* — G. M. Hyder
(74) *Attorney, Agent, or Firm* — Holtz, Holtz, Goodman & Chick PC

(57) ABSTRACT

A printing apparatus includes a controller that, upon receipt of a printing suspension instruction during printing on a print medium by a printing device, causes a conveyor to stop a conveyance of the print medium from an upstream side to a downstream side after printing a mark on the print medium, causes the conveyor to convey the print medium from the downstream side to the upstream side, then to stop the conveyance of the print medium after a sensor detects the mark printed on the print medium, and upon receipt of a printing restart instruction, causes the conveyor to convey the print medium from a returned position where the print medium is stopped to the downstream side and controls a timing of a printing based on a detection of the mark by the sensor.

15 Claims, 7 Drawing Sheets

(56) References Cited

U.S. PATENT DOCUMENTS

| | | | | |
|---|---|---|---|---|
| 5,769,299 | A * | 6/1998 | Negoro | 226/24 |
| 7,174,125 | B2 | 2/2007 | Yamasaki | |
| 7,999,836 | B2 * | 8/2011 | Bandholz et al. | 347/218 |
| 8,075,211 | B2 | 12/2011 | Yamamoto | |
| 8,174,550 | B2 | 5/2012 | Mori | |
| 8,733,880 | B2 * | 5/2014 | Izawa et al. | 347/16 |
| 2003/0035671 | A1 * | 2/2003 | Estabrooks | 399/385 |
| 2005/0206715 | A1 * | 9/2005 | Sasaki et al. | 347/221 |
| 2006/0062617 | A1 * | 3/2006 | Yamasaki | 399/384 |
| 2012/0242735 | A1 * | 9/2012 | Izawa et al. | 347/16 |

FOREIGN PATENT DOCUMENTS

| | | | |
|---|---|---|---|
| JP | 2006091179 | A | 4/2006 |
| JP | 2006091184 | A | 4/2006 |
| JP | 2006225128 | A | 8/2006 |
| JP | 2008-191215 | A | 8/2008 |
| JP | 2010097132 | A | 4/2010 |
| JP | 2010201631 | A | 9/2010 |

OTHER PUBLICATIONS

Japanese Office Action dated Jun. 3, 2014 issued in counterpart Japanese Application No. 2012-195385.

* cited by examiner

PRINTING APPARATUS, PRINTING METHOD, AND STORAGE MEDIUM WHICH CONTROL PRINTING BASED ON DETECTION OF A MARK BY A SENSOR

CROSS-REFERENCE TO RELATED APPLICATION

This application claims the benefit of Japanese Patent Application No. 2012-195385, filed on Sep. 5, 2012, the entire disclosure of which is incorporated by reference herein.

FIELD

The present invention relates to an electrophotographic label printer using an elongated print medium.

BACKGROUND

In conventional electrophotographic label printers using an elongated print medium such as roll paper, when the printer engine needs to be stopped even during printing due to toner exchange, exchange of a regular exchange unit, cooling down, or the like, a waste region (blank) is produced on the roll paper during the time between the temporary suspension and restart. Then, after printing, the blank on the elongated print medium needs to be cut out.

Thus, Unexamined Japanese Patent Application Kokai Publication No. 2008-191215 has proposed a printing system that facilitates the cutting of, for example, such an elongated print medium by recording printing result information on a blank last page of the medium to automatically cut a waste region based on the information. However, the technique has not been to a fundamental solution to the elimination of wastefulness.

In other words, there are problems as follows. While printing is being performed on an elongated print medium such as roll paper, printing sometimes needs to be suspended to supply toner or for some other reason. However, as described above, the temporary suspension during printing causes a waste region to be produced on the elongated print medium and then processing such as cutting of the blank is necessary after printing. Therefore, printing suspension should be avoided as much as possible.

SUMMARY

The present invention is directed to solve the above conventional problems. It is an object of the present invention to provide a printing apparatus that produces no waste on an elongated print medium even when the printer is suspended during printing on the elongated print medium.

In order to achieve the object, a printing apparatus according to an aspect of the present invention includes a printing device that prints a toner image on a print medium, a conveyor that conveys the print medium from an upstream side of a conveyance path to a downstream side thereof, a fixing device arranged in the conveyance path to fix the toner image printed on the print medium by the printing device, a sensor arranged on a further upstream side than the fixing device in the conveyance path to detect a mark printed on the print medium, and a controller that, upon receipt of a printing suspension instruction during printing on the print medium by the printing device, causes the conveyor to stop the conveyance of the print medium from the upstream side to the downstream side after printing the mark on the print medium, causes the conveyor to convey the print medium from the downstream side to the upstream side, then to stop the conveyance of the print medium in response to the sensor detecting the mark printed on the print medium, and upon receipt of a printing restart instruction, causes the conveyor to convey the print medium from a returned position where the print medium is stopped to the downstream side and controls a timing of a printing based on a detection of the mark by the sensor.

In this way, the printing apparatus according to the aspect of the present invention achieves an advantageous effect of producing no waste on roll paper even when suspended during printing on the roll paper.

BRIEF DESCRIPTION OF THE DRAWINGS

A more complete understanding of this application can be obtained when the following detailed description is considered in conjunction with the following drawings, in which.

DETAILED DESCRIPTION

Figure 1:
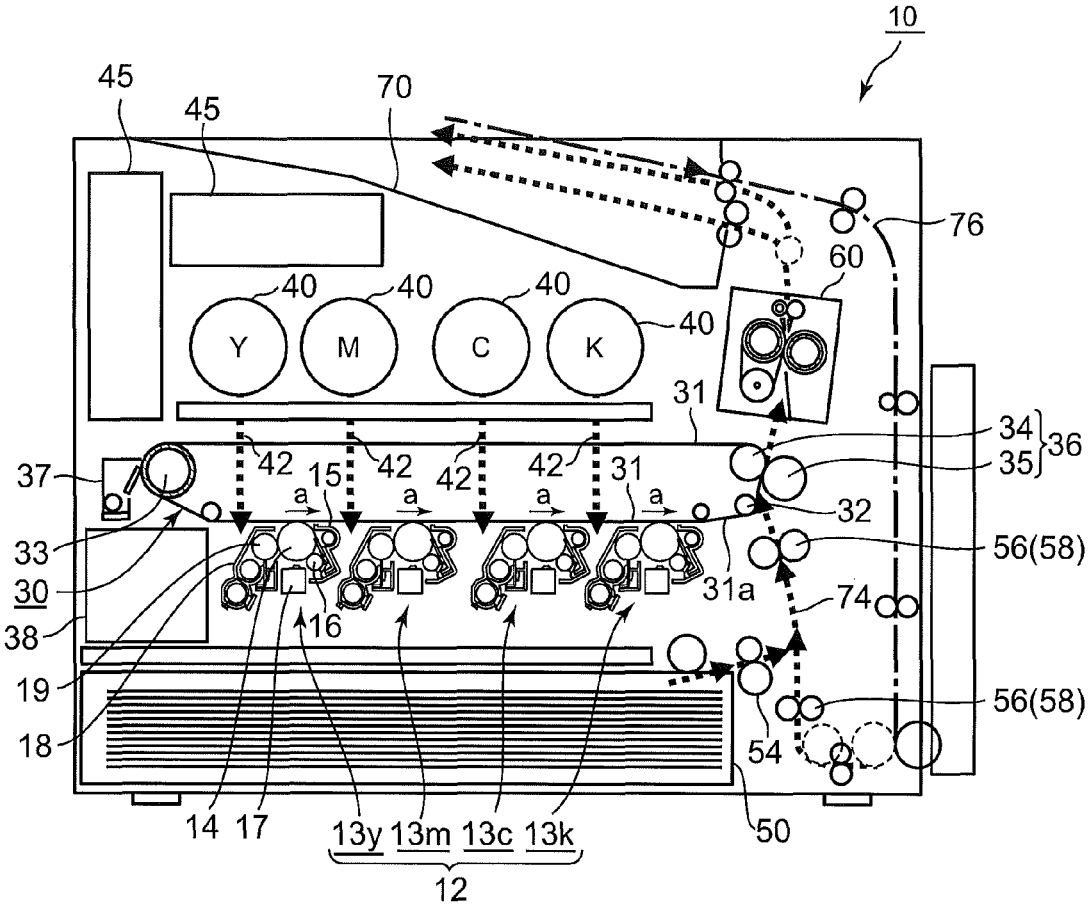
FIG. 1 is a cross-sectional view illustrating an inner structure of a full-color printer according to an embodiment of the present invention.

Hereinbelow, embodiments of the present invention will be described with reference to the drawings. FIG. 1 is a cross-sectional view illustrating an inner structure of a printer main body 10 used in a label printer 1 according to an embodiment of the present invention.

The printer main body 10 illustrated in FIG. 1 is a tandem type electrophotographic color image forming apparatus using a secondary transfer system and comprises a DSS section (drum/development devices) 12, a transfer belt device 30, a toner cartridge 40, an electrical component section 45, a paper feeder 50, and a fixing device 60.

In addition, the printer main body 10 comprises a back surface transfer system to minimize a first printing time. The toner cartridge 40 is positioned above the DSS section 12 (drum/development devices) via the transfer belt device 30, and the DSS section 12 comprising a photoreceptor and development system is positioned roughly immediately below the toner cartridge 40 via the transfer belt device 30. The transfer belt device 30 includes an intermediate transfer belt 31, a driving roller 32, and a driven roller 33.

The DSS section (drum/development devices) 12 is contacted with a lower running surface 31*a* of the intermediate transfer belt 31 of the transfer belt device 30 and comprises four development devices 13 (13*k*, 13*c*, 13*m*, and 13*y*) arranged in a multistage manner from the right to the left in FIG. 1.

Among the four development devices 13 (13*k*, 13*c* 13*m*, and 13*y*), the three development devices 13*c*, 13*m*, and 13*y*, respectively, on the upstream side (on the left side of FIG. 1) form mono-color images using color toners of cyan (C), magenta (M), and yellow (Y), respectively, that are three primary colors in subtractive color mixing. The development device 13*k* forms a monochromatic image using a black toner mainly used for characters, black parts of images, and the like.

The respective development devices 13 (13*k*, 13*c* 13*m*, and 13*y*) have the same structure except for the difference between the toner colors for developing images. Accordingly, the development device 13*y* for the yellow (Y) toner positioned on the most upstream side will be used as an example for illustrating the structure of the development devices 13.

The development device 13 (13*k*, 13*c* 13*m*, and 13*y*) is provided with a photoreceptor drum 14 on a top thereof. The photoreceptor drum 14 has a circumferential surface comprising, for example, an organic photoconductive material. A cleaner 15, a charging roller 16, an optical writing head 17, and a development roller 19 of the development device 18 are arranged in contact with the circumferential surface of the photoreceptor drum 14 or in a manner surrounding a vicinity of the circumferential surface thereof.

To the development device 18 is supplied one of the toners of black (K), cyan (C), magenta (M), and yellow (Y) indicated by K, Y, C, M, and Y in FIG. 1 from one of the four toner cartridges 40.

The transfer belt device 30 is provided with the above-described intermediate transfer belt 31 that is endless-shaped and extended in a flat loop shape in a lateral direction in FIG. 1 roughly at a center of the printer main body 10, as well as the driving roller 32 and the driven roller 33 around which the intermediate transfer belt 31 is laid so that the intermediate transfer belt 31 is circulated in a counterclockwise direction indicated by an arrow "a" in FIG. 1.

The transfer belt device 30 is further provided with a secondary transfer backup roller 34 around which the intermediate transfer belt 31 is laid above the driving roller 32. A secondary transfer roller 35 is pressed in contact with the secondary transfer backup roller 34 via the intermediate transfer belt 31 to form a secondary transferring device 36.

In the intermediate transfer belt 31 is incorporated a primary transfer roller (not shown) integrally with a unit. The primary transfer roller (not shown) directly transfers a toner image on the belt surface circulating in the lower position (primary transfer). The intermediate transfer belt 31 conveys the toner image to the secondary transferring device 36 where the secondary transfer roller 35 is pressed in contact with the secondary transfer backup roller 34 via the intermediate transfer belt 31 to additionally transfer the toner image on a print medium such as a paper (secondary transfer).

At the intermediate transfer belt 31 is arranged a belt cleaner 37 in contact with a surface of the belt laid around the driven roller 33. Below the belt cleaner 37 is arranged a waste toner collection container 38 that collects waste toner removed from the intermediate transfer belt 31 by the belt cleaner 37.

The toner cartridges 40 comprise the four ones arranged above an upper running surface of the intermediate transfer belt 31. The respective four toner cartridges contain toners of black (K), cyan (C), magenta (M), and yellow (Y), respectively, to be supplied.

Between the toner cartridges 40 and the DSS section (drum/development devices) 12 are arranged respective toner longitudinal conveyance paths 42, whereby a constant amount of toner is conveyed from each of the toner cartridges 40 under control by a toner supply signal from a toner concentration detector provided in the DSS section (drum/development devices) 12.

On a left side of the toner cartridges 40 are arranged two electrical component sections 45 in a region from a left side of the belt cleaner 37 to an upper side of the driven roller 33. The electrical component sections 45 include a printed circuit board with a controlling device comprising a plurality of electronic components mounted thereon.

The paper feeder 50 is provided with a paper feed cassette. Near a paper feed opening of the paper feed cassette (on the right side in FIG. 1) are arranged a feed roller 54 and a conveyor 58 including conveying rollers 56 that convey a print medium from the upstream side to the downstream side. A conveyance path 74 for conveying a print medium 200 is indicated by a broken line.

The secondary transferring device 36 described above is provided in a direction in which conveying rollers 56 convey the print medium (a vertical direction in FIG. 1). The fixing device 60 is arranged on a downstream side of the secondary transferring device 36 (on an upper side thereof in FIG. 1). A toner image is transferred on the print medium 200 conveyed vertically to the secondary transferring device 36 via the intermediate transfer belt 31, and then, the print medium 200 is further transferred vertically to the fixing device 60. The fixing device 60 fixes the toner image by a belt-type thermal fixing device.

On a further downstream side of the fixing device 60 is provided a paper feed tray 70 by which the print medium 200 conveyed from the fixing device 60 after fixing is placed on a top surface of the apparatus.

On a right side surface of the printer main body 10 is provided a double-sided printing conveyance unit. The double-sided printing conveyance unit includes a return path 76 that reverses the print medium 200 branched from a position immediately before the paper feed tray 70 and will be finally returned in a right side direction of FIG. 1. The return path 76 is indicated by a dot-and-dash line.

Figure 2:
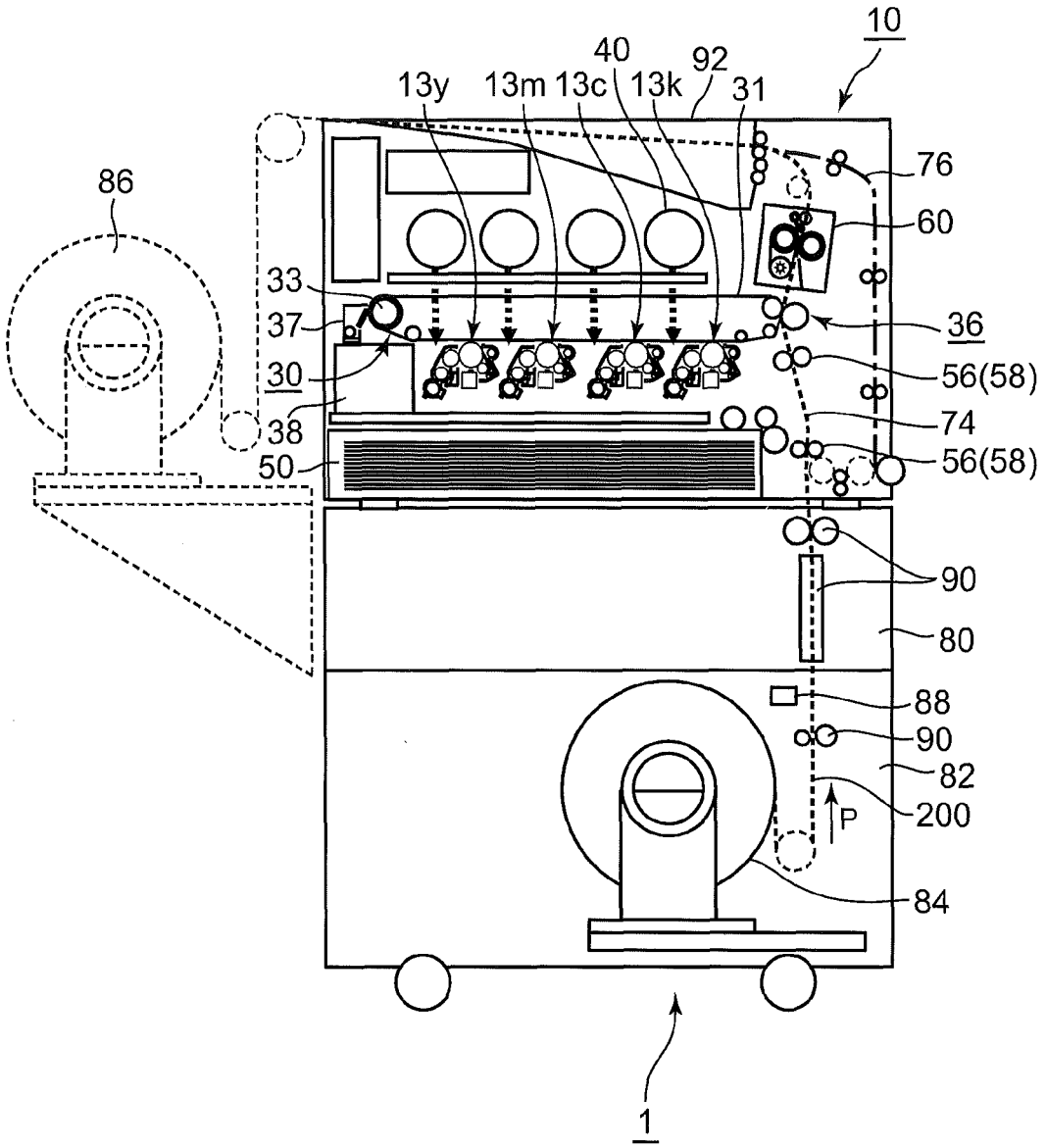
FIG. 2 is a cross-sectional view illustrating a main structure of a label printer equipped with a printer main body.

FIG. 2 is a cross-sectional view illustrating a main structure of the label printer 1 (referred to also as "label printing apparatus" or "printing apparatus") equipped with the printer main body 10. The label printer 1 includes a mounting box 80, a base unit 82, and a rewinder 86 as a winding device that continuously winds the print medium 200 having a roll shape. The base unit 82 is a base for supporting the entire label printer 1.

Inside the base unit 82 are provided an unwinder 84 as an unwinding device, a part of a roll-paper conveyor 90 conveying the print medium 200 to the printer main body 10 via the mounting box 80 on the base unit 82, and a sensor 88.

On the unwinder 84 is mounted the print medium 200 wound in the roll shape for label printing, and the unwinder 84 continuously supplies the mounted roll paper to the printer main body 10. The unwinder 84 is provided with a driving system such as a motor. The print medium 200 wound in the roll shape is also referred to as "roll paper" or "continuous sheet".

The roll paper conveyor 90 conveys the print medium 200 supplied from the unwinder 84 in a direction "p" (an upper direction in FIG. 2). The base unit 8 is provide with a motor for the unwinder 84, a transmission system for the motor, and an unwinder driver 84*a* indicated in FIG. 3 that drivingly controls the unwinder 84.

When the printer main body 10 is suspended during operation, the sensor 88 serves to detect a mark "M" printed on the print medium 200 in order to determine a position where the print medium 200 backfeed is to be stopped. The sensor 88 is an optical sensor used for reflection detection and arranged so as to face a printed surface of the print medium 200. Further details of the sensor 88 will be described later.

The mounting box 80 is arranged between the base unit 82 and the printer main body 10. The mounting box 80 includes a roller, as a part of the roll paper conveyor 90, for conveying the print medium 200 supplied from the unwinder 84 to the printer main body 10. In addition, the mounting box 80 further includes an automatic cutter for cutting the print medium 200.

The print medium 200 supplied from the mounting box 80 is guided into the printer main body 10. Then, a toner image is transferred thereon by the secondary transferring device 36, and the transferred toner image is fixed by the fixing device 60. The print medium 200 with the toner image printed thereon is ejected to a roll paper ejection section 92 at a top of the printer main body 10 and then conveyed in a left direction where the rewinder 86 is located.

The rewinder 86 is attached onto a left side of the mounting 80 in such a manner as to be exposed externally. The rewinder 86 is mounted at the same height position as the printer main body 10. The rewinder 86 serves to continuously wind up the roll-shaped print medium 200 after printing has been ended in the printer main body 10 and is provided with a driving system such as a motor.

Figure 3:
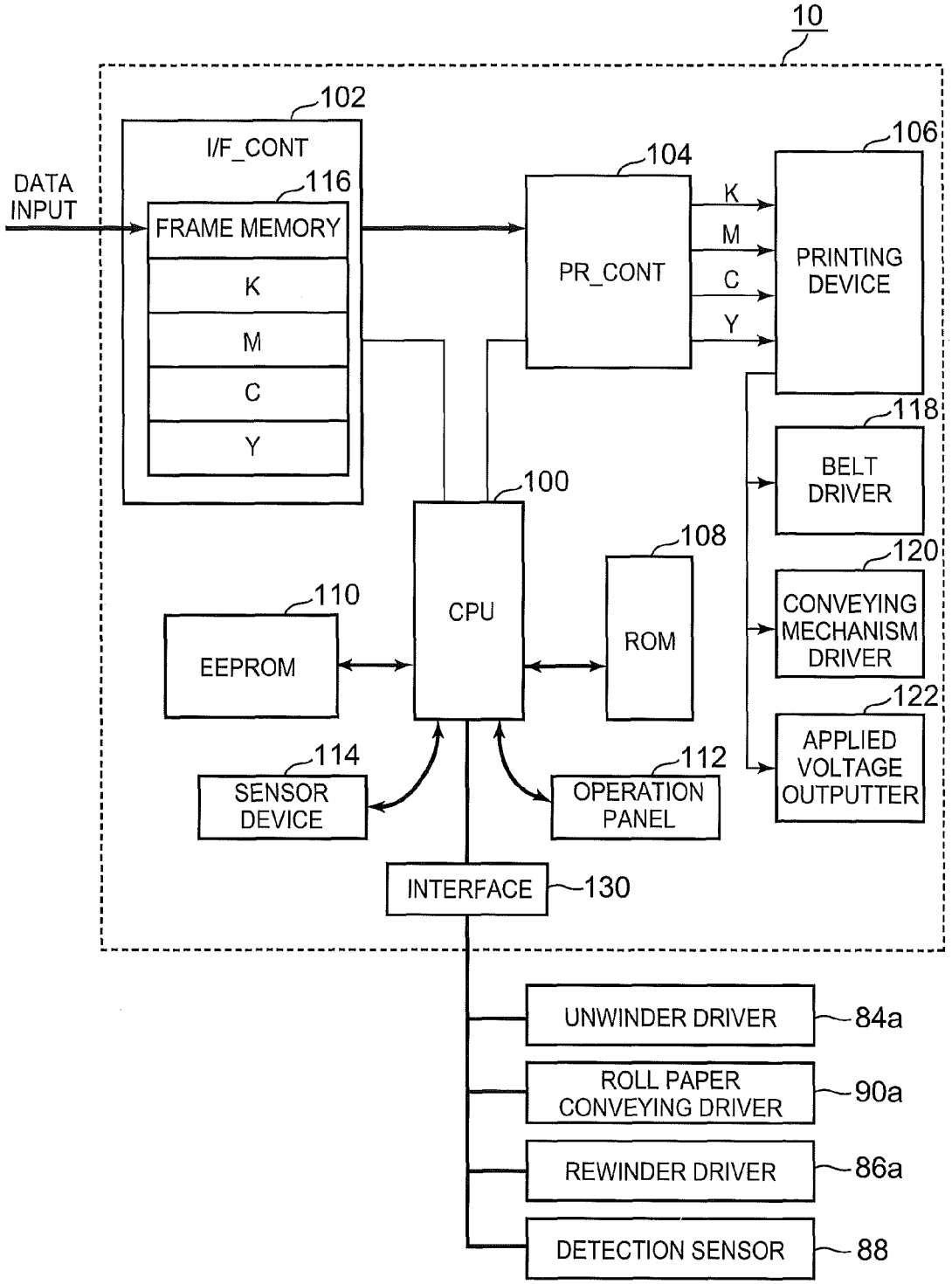
FIG. 3 is a block diagram of the label printer mainly illustrating the printer main body.

The mounting box 80 is provided with a roll paper conveyance driver 90*a* indicated in FIG. 3. The roll paper conveyance driver 90*a* drivingly controls the rewinder 86, the rewinder driver 86*a* in FIG. 3, and the roll paper conveyor 90. After printing, the print medium 200 is ejected from the roll paper ejection section 92 and then guided through a plurality of relay rollers to be wound by the rewinder 86.

FIG. 3 is a block diagram of the label printer 1 mainly illustrating the printer main body 10. As illustrated in FIG. 3, in the printer main body 10, to a central processing unit (CPU) 100 at the center are connected an interface controller (I/F_CONT) 102 and a printer controller (PR_CONT) 104, each via a data bus. To the (PR_CONT) 104 is connected a printing device 106. These electrical units are included in the electrical component sections 45.

To the CPU 100 are connected a read only memory (ROM) 108, an electrically erasable programmable ROM (EEPROM) 110, an operation panel 112 of a main body operator, and a sensor device 114 for receiving an output from a sensor arranged in each of the units. The ROM 108 stores a system program. According to the system program, the CPU 100 controls each unit to perform processing and serves as a controller. In addition, the system program includes a control program for the label printer, which will be described in FIG. 4.

Specifically, in each unit, first, the I/F_CONT 102 converts print data supplied from a host apparatus such as, for example, a personal computer to bitmap data and develops the data in a frame memory 116. The frame memory 116 has a storage area set for each of black (k), magenta (M), cyan (C), and yellow (Y), and data for the respective colors are developed in the respective corresponding areas.

The data developed in the frame memory 116 are output to the PR_CONT 104 and then output to the printing device 106 therefrom.

The printing device 106 is a an engine section and controls, under control from the PR_CONT 104, a driving output to a belt driver 118 performing vertical movement, rotational driving, and the like of the transfer belt device 30 indicated in FIG. 1

In addition, the printing device 106 controls a driving output to a conveying mechanism driver 120 that drives a conveying mechanism comprising the respective rotatably driven units, such as the conveying rollers 56, the photoreceptor drums 14, a heating roller of the fixing device 60.

Furthermore, the printing device 106 controls a process load of an image forming device including driven units such as the charging rollers 16, the optical writing heads 17, and the primary transfer roller and an output of an applied voltage outputter 122 outputting voltage to a rotational driving system including the secondary transfer roller 35.

Additionally, the printer main body 10 is provided with an interface (IF) 130 for connecting the CPU 100 to external equipment. The CPU 100 is connected to each electrical unit exclusive to the label printer 1 via the IF 130. To the CPU 100 are connected the unwinder driver 84*a* drivingly controlling the unwinder 84, the rewinder driver 86*a* drivingly controlling the rewinder, the roll paper conveyance driver 90*a* drivingly controlling the roll paper conveyor 90, and the sensor 88 in the label printer 1.

When the mounting box 80 and the base unit 82 are connected to the printer main body 10 to build the label printer 1, the CPU 100 serves as a controller of the label printer 1 according to a label printer control program in the system program.

As indicated in FIG. 2, in the label printer 1, the roll-shaped print medium 200 is mounted on the unwinder 84 and a top end of the print medium 200 is manually or automatically stood-by at a start position on the roll paper conveyor 90.

The top end of the print medium 200 is stopped at a standby position of the printer main body 10 engine to be controlled such that a printing position of the medium matches with a secondary transfer position in accordance with image formation of the printer main body 10, followed by starting of printing. The print medium 200 ejected from the printer main body 10 is guided through the roll paper ejector 92 at the upper surface of the printer main body 10 to be wound up by the rewinder 86.

When starting printing from the top end of the print medium 200 as described above, it is also possible to easily perform matching of the printing position. However, in image formation by the printer, processing speed should not change engine speed. Accordingly, it is possible to form a slack on the unwinder 84 and the rewinder 86 including the respective driving sources, and a slack sensor (not shown) for detecting the slack is provided to control such that the engine speed of the printer is not affected by the processing speed. When cutting the medium each time labels are printed in small amounts, the automatic cutter (not shown) is used for cutting and a position control (top-end matching) for the next job is also performed here.

In the label printer 1, during continuous label printing on the roll-shaped print medium, it is desirable that no printing suspension is performed. However, due to toner depletion or some other reason such as temperature increase in the fixing device, printing suspension is sometimes needed.

In the conventional label printer 1, when printing is restarted after suspension, a waste region is produced on a part of the roll paper and after printing, processing such as cutting a blank is needed. In addition, although it is possible to restart printing after moving back a print medium by an amount of a length corresponding to the blank, it is difficult to move the print medium back to a precise position. Therefore, an interval between an image of the last page before suspension and a first image after restart is more likely to shift from a prescribed position.

With reference to FIGS. 4 to 6B, a description will be given of a printing method according to an embodiment of the present invention that is able to perform label printing at a constant pitch even when the label printer 1 restarts printing after suspension.

Figure 4:
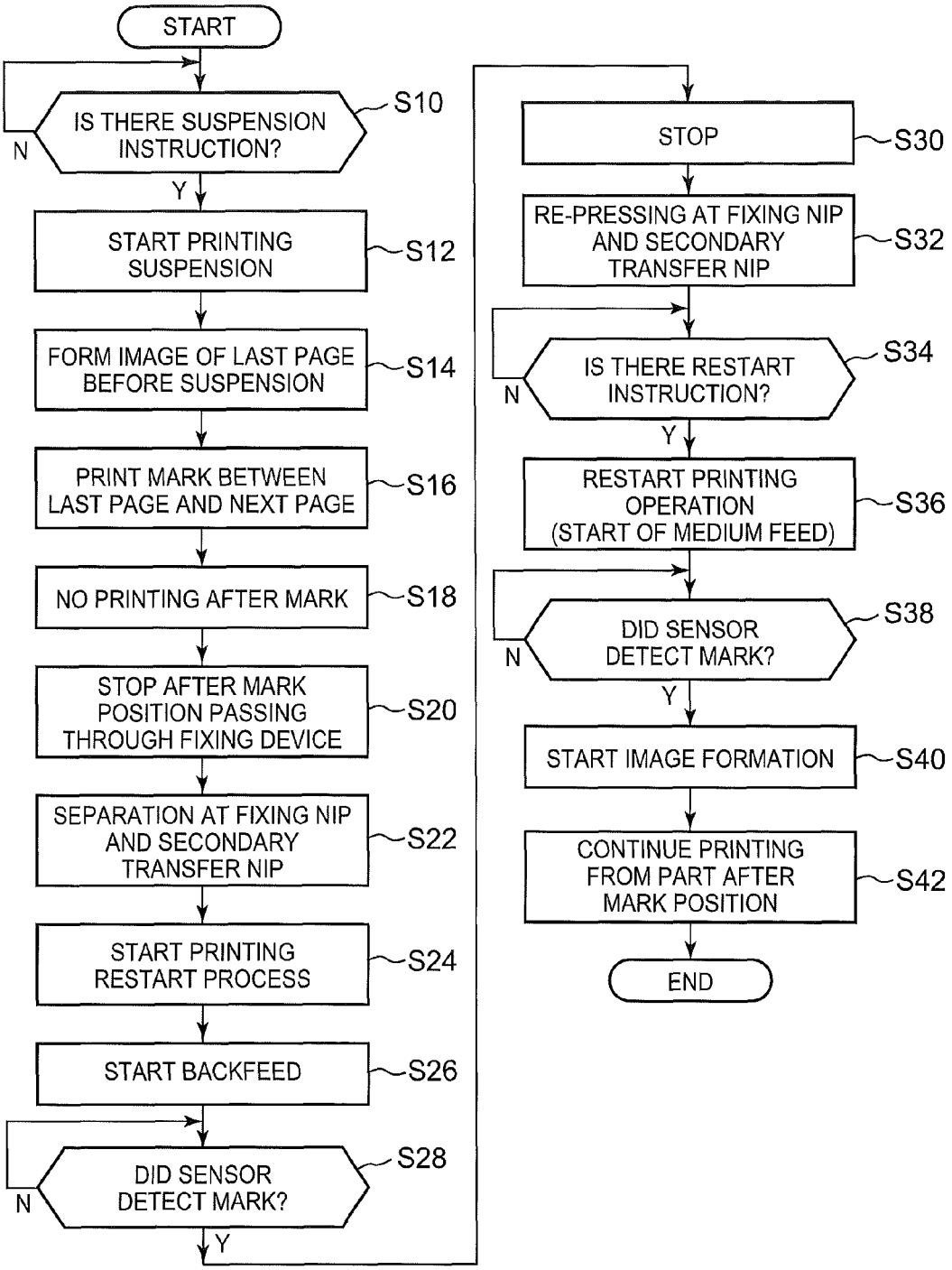
FIG. 4 is a flowchart illustrating processing steps executed from the occurrence of a suspension instruction to the restart of printing while the label printer is performing continuous printing on an elongated print medium.
Figure 5A:
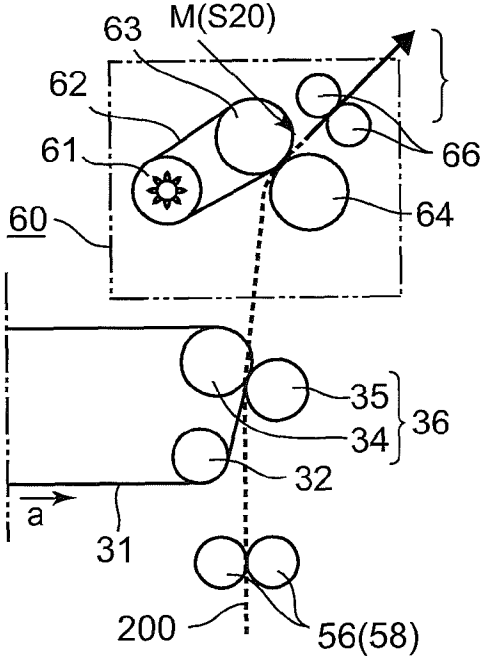
FIGS. 5A, 5B, and 5C are views illustrating a backfeed operation for a print medium performed between suspension and restart.
Figure 5B:
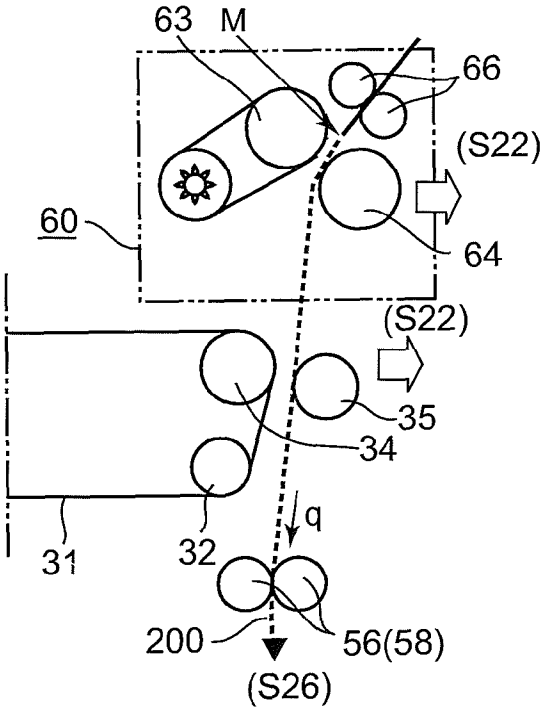
Figure 5C:
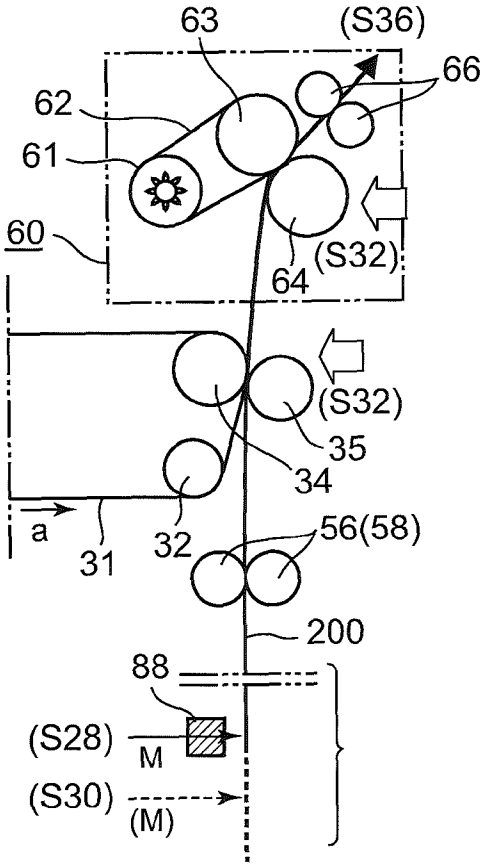
Figure 6B:
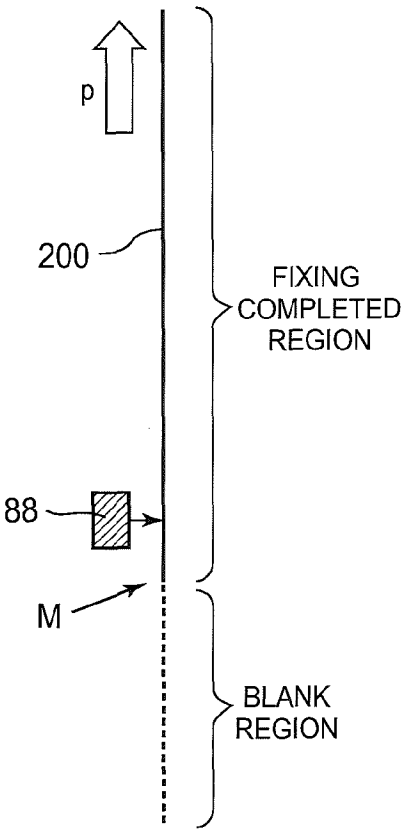
FIGS. 6A and 6B are views schematically illustrating an image pattern printed on the print medium upon suspension.
Figure 6A:
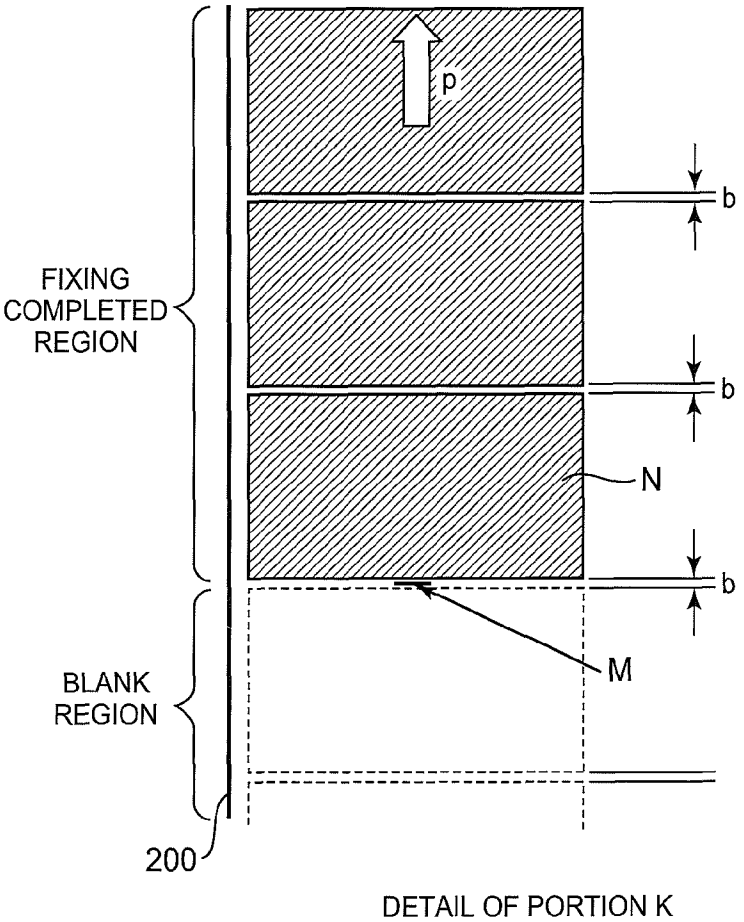

FIG. 4 is a flowchart illustrating processing steps executed from the occurrence of suspension instruction to the restart of printing during continuous printing on the roll-shaped print medium by the label printer 1. FIGS. 5A, 5B, and 5C are views illustrating a backfeed operation for the print medium 200 performed between the suspension and the restart of printing. FIGS. 6A and 6B are views schematically illustrating an image pattern printed on the print medium 200 upon suspension.

According to a sequential order of the flowchart of FIG. 4, a description will be given hereinbelow with reference to FIGS. 5A to 5C and FIGS. 6A and 6B. A series of processings indicated in FIG. 4 are those executed mainly by the CPU 100 in accordance with the program. In the processings, the CPU 100 forms a printing controller that controls continuous printing of an image on the continuous print medium.

First, during continuous printing, it is determined whether there is a suspension instruction or not (Step S10). Examples of giving a suspension instruction include those as follows:

Shortage of residual toner (the amount of residual toner is not more than a threshold value);

Cooling-down operation due to increased temperature at an end portion of the fixing device or any other reason;

Adjustment operation of color superimposition (registration);

Toner discharging operation for maintaining of belt cleaning or other reasons; and Other necessary stopping operations other than a sudden suspension. In some cases, suspension operation is performed due to a decision of an operator.

When it is determined that there is no suspension instruction (step S10: NO), the step S10 is looped, whereas when determined that there is a suspension instruction (step S10: YES), printing suspension is started (step S12), and then image formation of the last page before the suspension is performed (step S14).

An image of the last page is referred to also as "last image N". Next, a mark M is printed between the last page and the next page (step S16). The next page refers to an image that is first to be printed after restarting printing. The shape and the like of the mark M will be described below with reference to FIGS. 6A and 6B. The mark M is a short horizontal line that will be printed at a rear end of the last image N.

However, the shape of the mark M is not particularly limited to the short horizontal line and an uncommon complicated pattern image that is not used in ordinary printing is also usable. By doing this, even if the last image N includes an image having the same shape as the mark M and the image is present in the same position as the mark M in a widthwise direction of the elongated print medium 200, it is possible to prevent that the sensor 88 falsely recognizes, as the mark M, the image having the same shape as the mark M on the last image N.

Additionally, as shapes of the mark M, it is also possible to store in advance a plurality of images in memory. By doing this, even if the same image as a mark M that should be usually printed as a default is included in the last image N, it is possible to print an image different from the image of the default as a mark M for urgency.

Furthermore, even if the last image N includes an image having the same shape as the mark M, printing of the mark M in a region including a portion outside a printing region for the last image N positioned further outside than a printing width of the last image N is able to prevent the sensor 88 from falsely recognizing, as the mark "M", the image having the same shape as the mark "M" on the last image N, since the image is present in the position different from the position of the mark "M" in the widthwise direction of the elongated print medium 200.

In the manner as described above, it is possible for the sensor 88 to accurately detect the mark M, and thereby, it is possible to accurately control a timing of reprinting.

If possible, the mark M is desirably positioned near the center in the widthwise direction of the elongated print medium 200. By doing this, even when a length of the widthwise direction of the elongated print medium 200 varies depending on the print medium 200, it is sufficient as long as the length of the widthwise direction thereof allows the detection of a region including a portion near the center, so that as the sensor 88, a relatively short, compact sensor usable. Accordingly, it is unnecessary to provide a large sensor 88 necessary to detect the entire widthwise direction.

Then, no printing is performed after the mark M (step S18) and after the position of the mark M has passed through the fixing device 60, conveyance of the print medium is stopped (step S20) to print the mark M without fail. After determining that the position of the mark M has surely passed through the fixing device 60, the conveyance of the print medium 200 is stopped. For example, the determination is made based on the number of rotation of the secondary transfer roller 35 or the like.

FIG. 5A illustrates the state of rollers near the fixing device 60 with respect to the print medium 200 in a state in which the conveyance of the print medium 200 has been stopped.

Inside the fixing device 60 are provided a driving roller 61, a fixing thermal belt 62, a fixing roller 63, a backup roller 64, and fixing conveying rollers 66. The fixing thermal belt 62 heats the printed surface of the print medium 200 to fix a transferred toner image on the print medium 200.

The fixing thermal belt 62 is laid around the driving roller 61 and the fixing roller 63 to drive the fixing thermal belt 62 by rotation of the driving roller 61. The backup roller 64 conveys the print medium 200 while pressing the medium against the fixing thermal belt 62.

The fixing conveying rollers 66 eject the print medium 200 on which toner has been fixed as an image by the fixing thermal belt 62, from the fixing device 60.

When the conveyance has been stopped at the step S20, the print medium 200 is in a state of being pressed (sandwiched) by the backup roller 64 and the fixing conveying rollers 66 inside the fixing device 60. In addition, the print medium 200 is in a state of being pressed (sandwiched) by the conveying rollers 56, the secondary transfer backup roller 34 and the secondary transfer roller 35, and others.

In this state, the mark M is at a position that has slightly passed through the fixing thermal belt 62 and, as described above, the mark M is also fixed as an image. A range of the print medium 200 indicated by a solid line represents a portion where fixing has been completed, whereas a range thereof indicated by a broken line represents a portion where fixing has not been done yet (also the same in FIGS. 5B and 5C).

Then, from this state, separation is performed at a fixing nip and a secondary transfer nip, respectively (step S22). As indicted in FIG. 5B, the backup roller 64 and the secondary transfer 35, respectively, are separated.

After the separation, a printing restart process is started (step S24). Backfeeding is started (step S26). The term "backfeeding" refers to conveyance of the print medium 200 in a returning direction, namely in a reverse direction (direction q). Backfeeding is performed by counter-rotating the conveying rollers 56 and the fixing conveying rollers 66.

While backfeeding the print medium 200, it is determined whether or not the sensor 88 detected the mark M (step S28). In other words, the print medium 200 is backfed until the mark M passes through the sensor 88. After determining that the sensor 88 detected the mark M (step S28: YES), the conveyance of the print medium 200 is stopped (step S30). A position where the print medium 200 is stopped is referred to also as "returned position".

FIG. 5C illustrates a state of the print medium 200 stopped due to the detection of the mark M by the sensor 88 after backfeeding. Here, the print medium 200 is stopped not immediately after the sensor 88 detects the mark M, but after a lapse of a predetermined time from the detection or after returning the medium further upstream by a predetermined length.

This position corresponds to the returning position. In this manner, the position of the mark M is returned to a position further ahead (on the upstream side) than the position detected by the sensor 88.

FIGS. 6A and 6B are enlarged views of a portion of the print medium 200 indicated as a portion K in FIG. 5C. FIG. 6A is a view of the print medium 200 as seen from a printing surface, and FIG. 6B is a side view thereof.

The direction p of FIG. 6A (an upper direction in the drawing) is a direction along which the print medium 200 is conveyed. Upper three images of the print medium 200 indicated by diagonal lines represent images where fixing has been completed. An image of the last page upon suspension corresponds to the last image N. Each of the images is printed at a constant interval b, as indicated in FIG. 6A.

A horizontal line printed immediately under the last image N at the center in the widthwise direction of the print medium 200 is the mark M. The color and size of the mark M is any as long as the mark is detectable by the sensor 88 and it is also possible to employ a circle or a dot for the mark M. The position for printing the mark M is not particularly limited as long as the position therefore is near the last image N, and the position does not have to be the center in the widthwise direction of the print medium 200. As described at step S18, the region continuing under the mark M is a blank portion, namely, a non-printed portion.

As illustrated in FIG. 6B, the sensor 88 is arranged so as to face the printing surface of the print medium 200, and as described at step S28, the print medium 200 is stopped in the position where the mark M is located further upstream than the sensor 88. An upper portion of the print medium 200 than the mark M as indicated by a solid line corresponds to a portion where fixing has been completed and a lower portion thereof than the mark M as indicated by a broken line corresponds to a blank portion.

Referring now back to FIG. 4, when the portion to be fixed has reached a predetermined temperature after suspension, re-pressing is performed at the fixing nip and the secondary transfer nip, respectively (step S32). In other words, as illustrated in FIG. 5C, the backup roller 64 and the secondary transfer roller 35, respectively, are pressed against the printed medium 200. Since the fixing device starts from a cold state, it is necessary to take some time to restart printing after suspension. Starting from a state of sandwiching the print medium 200 causes a problem in temperature rising.

Then, it is determined whether there is a restart instruction or not (step S34). The restart instruction is given, for example, by inputting from the operation panel 112. When there is no restart instruction (step S34: NO), the step S34 is looped. When determined that there is a restart instruction (step S34: YES), printing operation is restarted (step S36), followed by starting of a forward conveyance of the print medium 200 such as a sheet.

After starting the forward conveyance thereof, it is determined whether the sensor 88 detected the mark M or not (step S38). This is because the mark M is positioned further upstream than the position of the sensor 88 upon the stopping of the conveyance at the step S30 (FIGS. 5C and 6B).

When the sensor 88 does not detect the mark M (step S38: NO), the step S38 is looped. When it is determined that the sensor 88 detected the mark M (step S38: YES), image formation is started in concert with the timing (step S40). Primary transfer by the development devices 13 (13*k*, 13*c*, 13*m*, and 13*y*) is started. Printing is continued from a part after the mark position (step S42).

Figure 7:
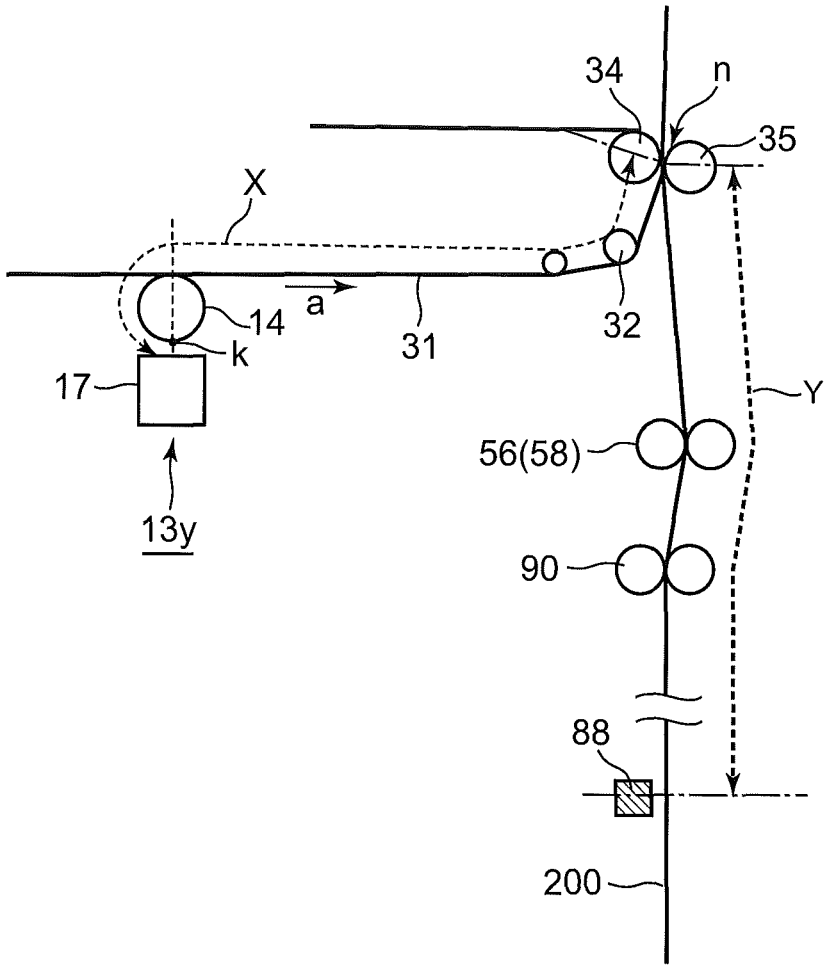
FIG. 7 is a view illustrating a relation of an arrangement position of a sensor with respect to a transfer belt device.

FIG. 7 is a view illustrating a relation of the arrangement position of the sensor 88 with respect to the transfer belt device 30. In order to set a timing for continuously printing images after restart following the last image N, the sensor 88 needs to be arranged further upstream than a length corresponding to a conveyance path length of the intermediate transfer belt 31.

FIG. 7 illustrates, regarding the DSS section (drum/development devices) 12 in FIG. 1, only the photoreceptor drum 14 and the optical writing head 17 of the development device 13*y* on the most upstream side, excluding the development devices 13*m*, 13*c*, and 13*k* on a further downstream side than the development device 13*y*.

First, a distance X is obtained that is a length from a charging position k of an image forming color of a first toner image (top image) to a secondary transfer nip position n at the secondary transferring device 36 through a primary transfer position. Since the first image forming color is formed by the yellow development device 13*y*, the position k where the photoreceptor drum 14 of the development device 13*y* faces the optical writing head 17 thereof is a first charging position. The distance X is a distance from the above position to the secondary transfer nip position n of the secondary transfer backup roller 34 and the secondary transfer roller 35.

Next, a distance of a conveyance path for the print medium 200 from the sensor 88 detecting the mark M to the secondary transfer nip position n is set as Y. The distance Y is, as indicated in FIG. 7, a distance from the position of the sensor 88 to the secondary transfer nip position n of the secondary backup roller 34 and the secondary transfer roller 35 along the conveyance path of the print medium 200. Accordingly, the sensor 88 needs to be arranged in a position that satisfies $Y \geq X$.

In this manner, following the last image N, it is possible to print a first image after restart at the predetermined interval b. A few images including the last image N are subjected to fixing processing twice, but there is no practical problem.

It is possible to achieve the embodiments of the present invention as described above at least following advantageous effects:

1) Even when printing is suspended during continuous printing and then restarted, labels (images) are continuously printed on the roll-shaped print medium 200, so that it is possible to perform printing suspension according to the need and it is possible to maintain favorable print quality.
2) Since no blank portion due to suspension is produced on the roll-shaped print medium 200, it is possible to use the print medium 200 without any waste. In addition, cutting in the subsequent step is unnecessary.
3) The print medium 200 usable is not one with the mark M previously printed thereon but a commonly available one. Accordingly, there is versatility of use.

4) It is sufficient to only provide a sensor, thus resulting in cost reduction.

5) Since the mark M is printed on a space between labels (images), printing of the mark M does not produce any waste on the print medium 200.

Additionally, while the above printing control processing has been described using an example of the software processing by the CPU 100 according to the program, the printing control processing is not limited thereto and it is also possible to be performed entirely or partially by hardware processing.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. A printing apparatus comprising:

a printing device that prints a toner image on a print medium;

a conveyor that conveys the print medium from an upstream side of a conveyance path to a downstream side thereof;

a fixing device arranged in the conveyance path to fix the toner image printed on the print medium by the printing device;

a sensor arranged on a further upstream side than the fixing device in the conveyance path to detect a mark printed on the print medium; and a controller that, upon receipt of a printing suspension instruction during printing on the print medium by the printing device, causes the conveyor to stop the conveyance of the print medium from the upstream side to the downstream side after printing the mark on the print medium, causes the conveyor to convey the print medium from the downstream side to the upstream side, then to stop the conveyance of the print medium in response to the sensor detecting the mark printed on the print medium, and upon receipt of a printing restart instruction, causes the conveyor to convey the print medium from a returned position where the print medium is stopped to the downstream side and controls a timing of a printing based on a detection of the mark by the sensor;

wherein the printing device comprises a transfer belt that conveys a toner image subjected to a primary transfer and a secondary transferring device that transfers the toner image conveyed by the transfer belt on the print medium;

wherein when a distance from a charging position of an image forming color of a first toner image that is to be subjected to the primary transfer to a position of a secondary transfer by the secondary transferring device through a position of the primary transfer is set as X and a distance of a conveyance path for the print medium from the sensor detecting the mark to the secondary transfer position is set as Y, $Y \geq X$ is satisfied.

2. The printing apparatus according to claim 1, wherein after printing the mark on the print medium indicates a state of completion of fixing by the fixing device; and wherein controlling the timing of the printing by the controller refers to an adjustment of a timing of transfer on the print medium by the secondary transferring device.

3. The printing apparatus according to claim 1, wherein the print medium is continuous, and the printing apparatus further comprises an unwinder that supplies the continuous print medium to the secondary transferring device and a rewinder that winds up the continuous print medium that has been subjected to printing.

4. The printing apparatus according to claim 1, wherein the print medium is stopped at a position where the print medium is conveyed on the further upstream side by a predetermined length after the detection by the sensor, and when printing is restarted, the print medium is conveyed from the returned position to the downstream side by the conveyor and image formation is performed based on a detection timing of the mark position by the sensor.

5. The printing apparatus according to claim 2, wherein when the print medium is conveyed from the downstream side to the upstream side, a secondary transfer roller of the secondary transferring device is separated from the print medium, and after the print medium is stopped at the returned position, the secondary transfer roller of the secondary transferring device is pressed against the print medium.

6. The printing apparatus according to claim 2, wherein the print medium is stopped at a position where the print medium is conveyed on the further upstream side by a predetermined length after the detection by the sensor, and when printing is restarted, the print medium is conveyed from the returned position to the downstream side by the conveyor and image formation is performed based on a detection timing of the mark position by the sensor.

7. The printing apparatus according to claim 2, wherein the print medium is continuous, and the printing apparatus further comprises an unwinder that supplies the continuous print medium to the secondary transferring device and a rewinder that winds up the continuous print medium that has been subjected to printing.

8. The printing apparatus according to claim 5, wherein the print medium is stopped at a position where the print medium is conveyed on the further upstream side by a predetermined length after the detection by the sensor, and when printing is restarted, the print medium is conveyed from the returned position to the downstream side by the conveyor and image formation is performed based on a detection timing of the mark position by the sensor.

9. The printing apparatus according to claim 5, wherein the print medium is continuous, and the printing apparatus further comprises an unwinder that supplies the continuous print medium to the secondary transferring device and a rewinder that winds up the continuous print medium that has been subjected to printing.

10. The printing apparatus according to claim 8, wherein the print medium is continuous, and the printing apparatus further comprises an unwinder that supplies the continuous print medium to the secondary transferring device and a rewinder that winds up the continuous print medium that has been subjected to printing.

11. A printing method in a printing apparatus comprising a printing device that prints a toner image on a print medium, a conveyor that conveys the print medium from an upstream side of a conveyance path to a downstream side thereof, a fixing device arranged in the conveyance path to fix the toner image printed on the print medium by the printing device, a sensor arranged on a further upstream side than the fixing device in the conveyance path to detect a mark printed on the print medium, a transfer belt that conveys a toner image subjected to a primary transfer, and a secondary transferring device that transfers the toner image conveyed by the transfer belt on the print medium, the printing method comprising:

upon receipt of a printing suspension instruction during printing on the print medium by the printing device, causing the conveyor to stop the conveyance of the print medium from the upstream side to the downstream side after the mark is printed on the print medium;

causing the conveyor to convey the print medium from the downstream side to the upstream side, then to stop the conveyance of the print medium in response to the sensor detecting the mark printed on the print medium; and upon receipt of a printing restart instruction, causing the conveyor to convey the print medium from a returned position where the print medium is stopped to the downstream side and controlling a timing of a printing based on a detection of the mark by the sensor;

wherein when a distance from a charging position of an image forming color of a first toner image that is to be subjected to the primary transfer to a position of a secondary transfer by the secondary transferring device through a position of the primary transfer is set as X and a distance of a conveyance path for the print medium from the sensor detecting the mark to the secondary transfer position is set as Y, $Y \geq X$ is satisfied.

12. The printing method according to claim 11, wherein after printing the mark on the print medium indicates a state of completion of fixing by the fixing device; and wherein controlling the timing of the printing refers to an adjustment of a timing of transfer on the print medium by the secondary transferring device.

13. The printing method according to claim 12, wherein when the print medium is conveyed from the downstream side to the upstream side, a secondary transfer roller of the secondary transferring device is separated from the print medium, and after the print medium is stopped at the returned position, the secondary transfer roller of the secondary transferring device is pressed against the print medium.

14. A non-transitory storage medium storing a program for executing a printing method by a computer of a printing apparatus comprising a printing device that prints a toner image on a print medium, a conveyor that conveys the print medium from an upstream side of a conveyance path to a downstream side thereof, a fixing device arranged in the conveyance path to fix the toner image printed on the print medium by the printing device, a sensor arranged on a further upstream side than the fixing device in the conveyance path to detect a mark printed on the print medium, a transfer belt that conveys a toner image subjected to a primary transfer, and a secondary transferring device that transfers the toner image conveyed by the transfer belt on the print medium, the program controlling the computer to perform operations comprising:

upon receipt of a printing suspension instruction during printing on the print medium by the printing device, causing the conveyor to stop the conveyance of the print medium from the upstream side to the downstream side after the mark is printed on the print medium;

causing the conveyor to convey the print medium from the downstream side to the upstream side and then to stop the conveyance of the print medium in response to the sensor detecting the mark printed on the print medium; and upon receipt of a printing restart instruction, causing the conveyor to convey the print medium from a returned position where the print medium is stopped to the downstream side and controlling a timing of a printing based on a detection of the mark by the sensor;

wherein when a distance from a charging position of an image forming color of a first toner image that is to be subjected to the primary transfer to a position of a secondary transfer by the secondary transferring device through a position of the primary transfer is set as X and a distance of a conveyance path for the print medium from the sensor detecting the mark to the secondary transfer position is set as Y, $Y \geq X$ is satisfied.

15. The storage medium according to claim 14, wherein after printing the mark on the print medium indicates a state of completion of fixing by the fixing device; and wherein controlling the timing of the printing refers to an adjustment of a timing of the transfer on the print medium by the secondary transferring device.

* * * * *